US010139069B2

(12) United States Patent
Zhang

(10) Patent No.: US 10,139,069 B2
(45) Date of Patent: Nov. 27, 2018

(54) PARTIALLY ALUMINIZED LENS FOR AUTOMOTIVE LAMP

(71) Applicant: SHANGHAI KOITO AUTOMOTIVE LAMP CO., LTD, Shanghai (CN)

(72) Inventor: Jie Zhang, Shanghai (CN)

(73) Assignee: SHANGHAI KOITO AUTOMOTIVE LAMP CO., LTD, Shanghai (CN)

( * ) Notice: Subject to any disclaimer, the term of this patent is extended or adjusted under 35 U.S.C. 154(b) by 39 days.

(21) Appl. No.: 15/539,108

(22) PCT Filed: Apr. 24, 2015

(86) PCT No.: PCT/CN2015/077398

§ 371 (c)(1),
(2) Date: Jul. 12, 2017

(87) PCT Pub. No.: WO2016/101463

PCT Pub. Date: Jun. 30, 2016

(65) Prior Publication Data

US 2017/0370547 A1 Dec. 28, 2017

(30) Foreign Application Priority Data

Dec. 24, 2014 (CN) ..... 2014 1 0838172

(51) Int. Cl.
*F21S 41/275* (2018.01)
*F21V 5/04* (2006.01)
(Continued)

(52) U.S. Cl.
CPC ..... *F21S 41/275* (2018.01); *F21S 41/141* (2018.01); *F21S 41/143* (2018.01); *F21S 41/265* (2018.01);
(Continued)

(58) Field of Classification Search
CPC ..... F21S 41/265; F21S 41/275; F21S 41/295; F21S 41/37; F21S 43/33
See application file for complete search history.

(56) References Cited

U.S. PATENT DOCUMENTS 6,132,074 A * 10/2000 Bristle ..... F21S 41/255 362/538
7,168,832 B2 * 1/2007 Komatsu ..... G02B 3/08 362/507
(Continued)

FOREIGN PATENT DOCUMENTS

EP 1052449 A2 * 11/2000 ..... F21S 41/255
EP 2187115 A2 * 5/2010 ..... F21V 29/70

OTHER PUBLICATIONS

Komatsu et al., Aug. 31, 2005, Espacenet EPO Machine translation of CN1661275(A), pp. 1-27.*
(Continued)

*Primary Examiner* — Alan B Cariaso
(74) *Attorney, Agent, or Firm* — CBM Patent Consulting, LLC

(57) ABSTRACT

A partially aluminized lens for an automotive lamp which is set in front of the automotive lamp light source and comprised of a light-incident surface and a light-emitting surface forming the main light shape, and the reflection surface forming the auxiliary light shape. The aforesaid light-incident surface and the light-emitting surface forming the main light shape is completed by a plano-convex lens. The aforesaid reflection surface forming the auxiliary light shape is completed by a reflection frame integrated and provided with the plano-convex lens, and the aforesaid reflection frame is formed by partial aluminization.

7 Claims, 2 Drawing Sheets

(51) Int. Cl.

| | |
|---|---|
| ***F21S 43/33*** | (2018.01) |
| ***F21S 41/37*** | (2018.01) |
| ***F21S 41/141*** | (2018.01) |
| ***F21S 41/143*** | (2018.01) |
| ***F21S 41/265*** | (2018.01) |
| ***F21S 41/32*** | (2018.01) |
| *F21W 107/10* | (2018.01) |
| *F21Y 101/00* | (2016.01) |
| *F21S 41/29* | (2018.01) |
| *F21S 45/47* | (2018.01) |

(52) U.S. Cl.

CPC ..... *F21S 41/32* (2018.01); *F21S 41/37* (2018.01); *F21S 43/33* (2018.01); *F21V 5/04* (2013.01); *F21S 41/295* (2018.01); *F21S 45/47* (2018.01); *F21W 2107/10* (2018.01); *F21Y 2101/00* (2013.01)

(56) References Cited

U.S. PATENT DOCUMENTS

2013/0094210 A1* 4/2013 Rice ..... F21V 13/04
362/245
2016/0131323 A1* 5/2016 Youn ..... B60Q 1/0052
362/516

OTHER PUBLICATIONS

Kalze, Nov. 15, 2000, EPO Patent Translate of Description EP1052449, pp. 1-5.*

* cited by examiner

PARTIALLY ALUMINIZED LENS FOR AUTOMOTIVE LAMP

This application is the U.S. national phase of International Application No. PCT/CN2015/077398 filed on 24 Apr. 2015 which designated the U.S. and claims priority to Chinese Application Nos. CN201410838172.6 filed on 24 Dec. 2014, the entire contents of each of which are hereby incorporated by reference.

TECHNICAL FIELD

The invention relates to a field of automobile lighting, specifically to a partially aluminized lens for an automotive lamp.

BACKGROUND OF THE INVENTION

A light path from light source should be controlled according to different lighting functions of an automobile light to form a specific lighting shape. Meanwhile, requirements of the laws and regulations to the brightness of the test points of relevant lighting functions should be satisfied, especially the functions including the fog-light should also form the horizontal shadingshading lines on the ground, which is shown in FIG. 3; And especially the low beam function should also form the shading lines with inflection points on the ground to avoid dazzling the drivers and affecting the traffic safety, which is shown in FIG. 4.

The available optical module that can form the shading line of the low beam with inflection points is required to be comprised of a main low beam unit that can form a shading line with inflection points, and an auxiliary low beam unit that can form the horizontal shading line, which is shown in FIG. 6. However, the optical module is comprised of three units with complicated structure and large space occupied, of which the main low beam module is comprised of a LED light source, a main low beam mirror, a main low beam screen (shield) and a main low beam lens. Light emitted from the LED light source is reflected by the mirror to the main low beam lens, while the main low beam screen (shield) is set the shape of shading line with inflection points. The said shading line is set at the focus of the main low beam lens. The light shape with inflection points required for the low beam is formed with the screen (shield) of the shading line of the main low beam screen (shield), and is exposed to the ground with the amplification of the lens. However, the aforesaid main low beam unit has the following disadvantages: It has a low light efficiency normally 30%-40%, but the rated luminous flux of the available LED light source is about 1300 lumen, so the luminous flux of the aforesaid main low beam unit that is actually exposed to the round is between 300 lumen and 400 lumen. So the aforesaid main low beam unit cannot satisfy the requirement of the luminous flux between 500 lumens and 1000 lumens.

At present, the solution of the available technology is to reduce the range of illumination of the main low beam unit to about 20 degrees range of both sides of the ground in front of the automobile. But in practice, the range of illumination of the low beam is about 40 degrees of the inner side of the automobile, while about 70 degrees of the outer side of the automobile, so the auxiliary low beam unit is required for the supplementary illumination. The auxiliary low beam unit can be comprised of one or two auxiliary low beam modules, which can form the horizontal shading line with about 40 degrees of the inner side and about 70 degrees of the outer side of the automobile. The disadvantage of the auxiliary low beam unit is that it can only form the horizontal shading line, which cannot satisfy the requirement of the shading line of the low beam with inflection points. So the superposition of the two light shapes is required to form the function of the low beam illumination.

Besides, the aforesaid technology has the following problems:

1. The structure forming the horizontal shading line is achieved with a lens in accordance with another lighting unit that is set in the front. The whole structure is complicated with lots of components, and occupies more space;
2. Only a part of the luminosity emitted from the light source of the automobile can be applied by the lens, while the rest is all wasted;
3. The light that is not applied by the lens can also form the stray light, of which the influence should be removed with the shading settings.

SUMMARY OF THE INVENTION

To solve the aforesaid problems at one time based on simplification of structure and assembly, the invention provides a partially aluminized lens for an automotive lamp in terms of the optimal settings of the present technology. The specific technical solution is as follows:

A partially aluminized lens for an automotive lamp, which is set in front of an automotive lamp light source (1), characterized in that:

The aforesaid partially aluminized lens is comprised of a light-incident surface (2) and a light-emitting surface (3) forming a main light shape, and a reflection surface (4) forming an auxiliary light shape;

The aforesaid light-incident surface and light-emitting surface forming a main light shape is completed by a plano-convex lens (5);

The aforesaid reflection surface forming an auxiliary light shape is completed by a reflection frame (6) integrated and provided with the plano-convex lens, and the aforesaid reflection surface is formed by partial aluminization.

A succession part (7) is formed at the connection of the plano-convex lens and the reflection frame;

Through the light-incident surface of the plano-convex lens, the reflection surface of the reflection frame and the succession part, a light wave can form the main light shape with the horizontal shading line and the range of illumination of 35 degrees-45 degrees of the inner side, and 65 degrees-75 degrees of the outer side of the automobile, and can form the auxiliary light shape with the shading line with inflection points required for the low beam light shape, and with the range of illumination of both 15 degrees-25 degrees of the inner side and outer side of the automobile.

The partially aluminized lens for an automotive lamp of the invention, which is characterized in that:

The aforesaid light-incident surface forming the main light shape is plane or curved surface.

The partially aluminized lens for an automotive lamp of the invention, which is characterized in that:

The aforesaid reflection frame is set of bowl, and the aforesaid partially aluminized lens for an automotive lamp is fixed at the radiator of the automotive lamp light source with the succession part.

The partially aluminized lens for an automotive lamp of the invention, which is characterized in that:

The aforesaid aluminization has a thickness of 4.5~5.5 μm.

The partially aluminized lens for an automotive lamp of the invention, which is characterized in that:

The aforesaid reflection frame is partial aluminization at the inner side.

The partially aluminized lens for an automotive lamp of the invention, which is characterized in that:

The aforesaid reflection frame is partial aluminization at the outer side.

The partially aluminized lens for an automotive lamp of the invention, which is characterized in that:

The aforesaid automotive lamp light source is comprised of the array of 1~5 LED chips.

The partially aluminized lens for an automotive lamp of the invention is aimed at cost saving to perfect the structure, so the improved lens can satisfy the requirement of forming shading lines in a single process, thus eliminating the need for a complex structure formed by combining other light-emitting units via a single process. Furthermore, the invention has increased the utilization of the illumination within the safe allowance by improving the position of the lens and the light source. Moreover, the invention has also left out the former screen (shield) structure between the automotive lamp light source and the lens. The former complicated truck-mounted components are replaced with structural optimization.

Wherein, 1 indicates a automotive lamp light source; 2 indicates a light-incident surface; 3 indicates a light-emitting surface; 4 indicates a reflection surface; 5 indicates a plano-convex lens; 6 indicates a reflection frame; and 7 indicates a succession part.

EMBODIMENTS

Figure 1:
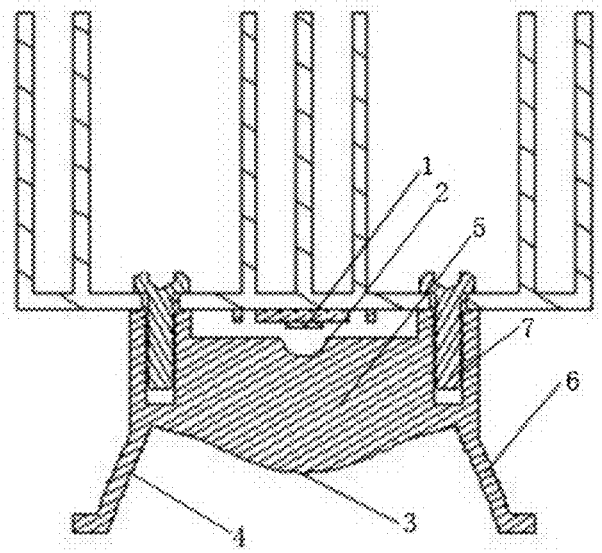
FIG. 1 is a structural diagram of the invention.

The partially aluminized lens for an automotive lamp of the invention is further described with the attached figures of the manual and the specific implementation method as follows:

As shown in FIG. 1, the partially aluminized lens for an automotive lamp is set in front of the automotive lamp light source (1). The aforesaid partially aluminized lens is comprised of the light-incident surface (2) and the light-emitting surface (3) forming the main light shape and the reflection surface (4) forming the auxiliary light shape;

The aforesaid light-incident surface and the light-emitting surface forming the main light shape is completed by a plano-convex lens (5);

The aforesaid reflection surface forming the auxiliary light shape is completed by a reflection frame (6) integrated and provided with the plano-convex lens.

The succession part (7) is formed at the connection of the plano-convex lens and the reflection frame;

Through the light-incident surface and the light-emitting surface of the plano-convex lens, the aforesaid light wave can form the main light shape with the horizontal shading line and the range of illumination of about 40 degrees of the inner side, and about 70 degrees of the outer side of the automobile. Through the light-incident surface of the plano-convex lens, the reflection surface of the reflection frame and the succession part, the aforesaid light wave can form the auxiliary light shape with the shading line with inflection points required for the low beam light shape, and with the range of illumination of both about 20 degrees of the inner side and outer side of the automobile. The low beam light shape is finally formed with the superposition of both light shapes.

The aforesaid automotive lamp light source is comprised of one or several square LED lighting chips in arrangement, usually the number of the LED lighting chip is 1~5. The aforesaid LED lighting chips can be regarded as the area light source. By placing the LED lighting chip at the focus of the lens, the light emitted from the LED lighting chip forms the illumination light shape with the horizontal shading line through the two refractions of the light-incident surface and the light-emitting surface;

The aforesaid light-incident surface forming the main light shape is plane or curved surface.

The aforesaid reflection frame is set of bowl, and the aforesaid partially aluminized lens for an automotive lamp is fixed at the radiator of the automotive lamp light source with the succession part.

Figure 3:
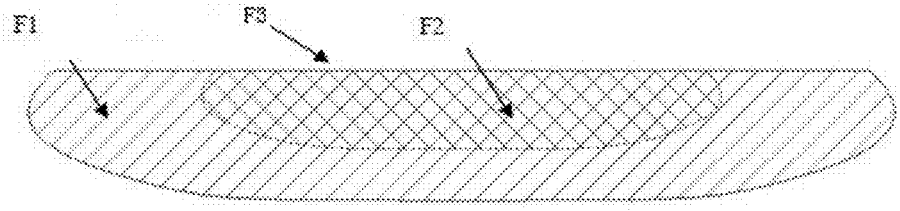
FIG. 3 is a diagram of the second kind of light shape of the invention.
Figure 4:
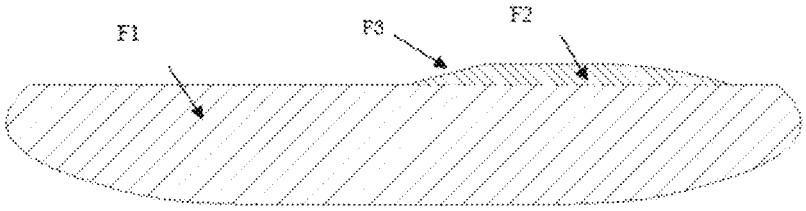
FIG. 4 is a diagram of the third kind of light shape of the invention.

The aluminization of the inner side and outer side of the aforesaid reflection frame can be achieved by partial vacuum aluminization process to avoid aluminization of the light-incident surface and the reflection surface of the lens, which can influence the formation of the main light shape. The aforesaid process of vacuum aluminization can form the reflecting aluminization layer with the thickness of about 5 μm on the surface of the lens. The aforesaid reflection frame is designed of specific shape according to the direction of the incident light, which can reflect the reflecting light to the needed illumination area, such as the position of the inflection point of the low beam shading line, to form the F2 light shape as shown in FIG. 4, and the F2 light shape in FIG. 2 to increase the illumination are, or the F2 light shape in FIG. 3 to increase the illumination strength of local areas.

Figure 5:
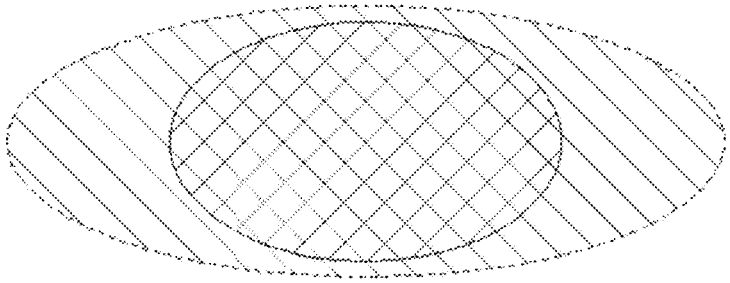
FIG. 5 is a diagram of the fourth kind of light shape of the invention.
Figure 6:
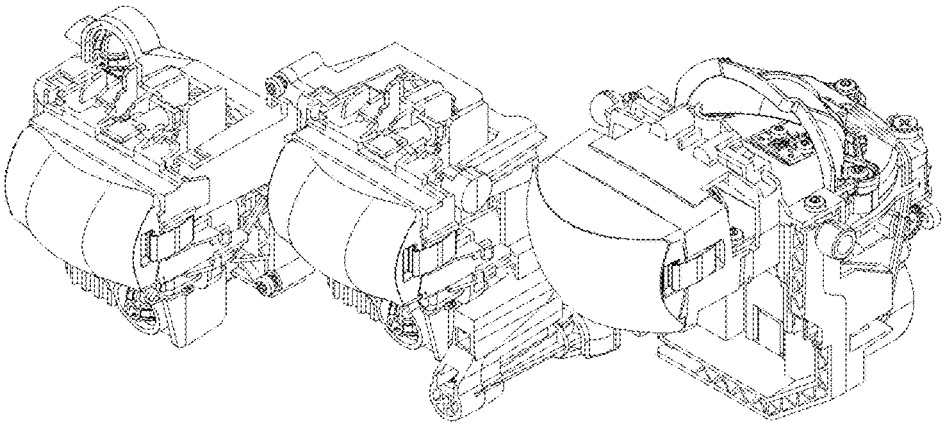
FIG. 6 is a structural diagram of the available technology.

As the supplementary function of the aforesaid partially aluminized lens for an automotive lamp, the partially aluminized lens can also be applied for the function of high-beam lighting. With specific design of light-emitting surface, the light emitted from the LED light source can form the main light shape F1 of the high-beam lighting as shown in FIG. 5 through the plano-convex lens, and form the supplementary light shape F2 with the reflection of the reflection surface of the reflection frame, ensuring the central brightness of the high beam and increasing the illumination range of the high beam at the same time.

Figure 2:
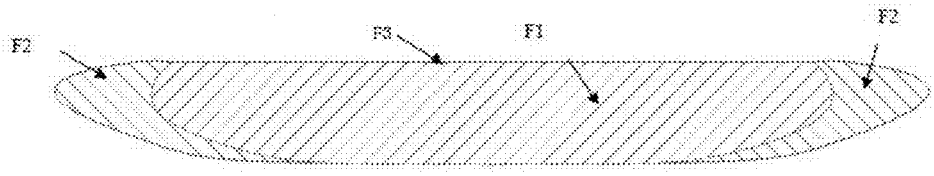
FIG. 2 is a diagram of the first kind of light shape of the invention.

The aforesaid partially aluminized lens for an automotive lamp can satisfy the requirement of the formation of the shading line at one time based on saving the cost and reducing the occupation of space with the settings of the reflection frame, which has specific screen (shield) effect at the same time. On this basis, the former structure that is alternatively set for light blocking can be left out by directly fixing the plano-convex lens to the radiator of the automotive lamp light source; The utilization of the automotive lamp light source is increased by optimizing again the distance between the convex lens and the automotive lamp light source; The requirement of different shading lines can be satisfied by setting different reflection frames (as shown in FIGS. 2, 3, and 4, and different light shapes achieved by different structures of the reflection frames, wherein F1 is the main light shape, F2 is the auxiliary light shape, and F3 is the shading line); The aforesaid reflection frame applies the partial vacuum aluminizing to form the reflecting surface, which can form the reflecting aluminum-plated layer with the thickness of about 5 μm at the inner side or outer side of the reflection frame, preferably 4.5 μm~5.5 μm. The reflection surface can be set of different shapes according to the direction of the incident light to form the required supplementary light shape, such as the F2 light shape in FIG. 2 that is applied to increase the range of illumination, the F2 light shape in FIG. 3 for local improvement of the illumination strength, the F2 light shape in FIG. 4 for the formation of the shading line with inflection points necessary for the low beam, and the improvement of the illumination range of the F1 high-beam light shape as shown in FIG. 5.

The partially aluminized lens for an automotive lamp is aimed at cost saving to perfect the structure, so the improved lens can satisfy the requirement of forming shading lines in a single process, thus eliminating the need for a complex structure formed by combining other light-emitting units via a single process. Furthermore, the invention has increased the utilization of the illumination within the safe allowance by improving the position of the lens and the light source. Moreover, the invention has also left out the former screen (shield) structure between the automotive lamp light source and the lens. The former complicated truck-mounted components are replaced with structural optimization.

What is claimed is:

1. A partially aluminized lens for an automotive lamp, which is set in front of the automotive lamp light source (1), wherein the aforesaid partially aluminized lens is comprised of a light-incident surface (2) and a light-emitting surface (3) forming a main light shape, and a reflection surface (4) forming an auxiliary light shape;

the aforesaid light-incident surface and the light-emitting surface forming the main light shape is completed by a plano-convex lens (5);

the aforesaid reflection surface forming the auxiliary light shape is completed by a reflection frame (6) integrated and provided with plano-convex lens, and the aforesaid reflection frame being formed by partial aluminization;

a succession part (7) is formed at the connection of the plano-convex lens and the reflection frame;

through the light-incident surface of the plano-convex lens, the reflection surface of the reflection frame and the succession part, a light wave can form the main light shape with horizontal shading line and the range of illumination of 35 degrees~45 degrees of an inner side, and 65 degrees~75 degrees of an outer side of the automobile, and can form the auxiliary light shape with the shading line with inflection points required for the low beam light shape, and with the range of illumination of both 15 degrees~25 degrees of the inner side and outer side of the automobile.

2. The aforesaid partially aluminized lens for an automotive lamp of claim 1, wherein the aforesaid light-incident surface forming the main light shape is plane or curved surface.

3. The aforesaid partially aluminized lens for an automotive lamp of claim 1, wherein the aforesaid reflection frame is set of bowl, and the aforesaid partially aluminized lens for an automotive lamp is fixed at the radiator of the automotive lamp light source with the succession part.

4. The aforesaid partially aluminized lens for an automotive lamp of claim 1, wherein the aforesaid aluminization has a thickness of 4.5~5.5 μm.

5. The aforesaid partially aluminized lens for an automotive lamp of claim 4, wherein the aforesaid reflection frame is partial aluminization at the inner side.

6. The aforesaid partially aluminized lens for an automotive lamp of claim 4, wherein the aforesaid reflection frame is partial aluminization at the outer side.

7. The aforesaid partially aluminized lens for an automotive lamp of claim 1, wherein the aforesaid automotive lamp light source is comprised of the array of 1~5 LED chips.

* * * * *